US011717046B2

(12) United States Patent
Coursimault et al.

(10) Patent No.: US 11,717,046 B2
(45) Date of Patent: Aug. 8, 2023

(54) PROTECTIVE HELMET AND METHOD FOR ADJUSTING A PROTECTIVE HELMET

(71) Applicant: ZEDEL, Crolles (FR)

(72) Inventors: Antoine Coursimault, Grenoble (FR); Clément Benoit, Le Sappey en Chartreuse (FR)

(73) Assignee: ZEDEL, Crolles (FR)

( * ) Notice: Subject to any disclaimer, the term of this patent is extended or adjusted under 35 U.S.C. 154(b) by 177 days.

(21) Appl. No.: 17/231,680

(22) Filed: Apr. 15, 2021

(65) Prior Publication Data

US 2021/0321708 A1 Oct. 21, 2021

(30) Foreign Application Priority Data

Apr. 15, 2020 (FR) ..... 2003798

(51) Int. Cl.
*A42B 3/14* (2006.01)
*A42B 3/12* (2006.01)

(52) U.S. Cl.
CPC ..... *A42B 3/145* (2013.01); *A42B 3/127* (2013.01); *A42B 3/142* (2013.01)

(58) Field of Classification Search
CPC ..... A42B 3/145; A42B 3/127; A42B 3/142; A42B 3/14
See application file for complete search history.

(56) References Cited

U.S. PATENT DOCUMENTS 5,373,588 A 12/1994 Hede et al.
2014/0109301 A1* 4/2014 Hall ..... A42B 3/142 2/416
2015/0327617 A1 11/2015 Gaudillere

FOREIGN PATENT DOCUMENTS

EP 0 558 427 A1 9/1993
WO 2005/016047 A1 2/2005
WO WO-2005016047 A1 * 2/2005 ..... A42B 3/145

* cited by examiner

*Primary Examiner* — Khoa D Huynh
*Assistant Examiner* — Erick I Lopez
(74) *Attorney, Agent, or Firm* — Oliff PLC

(57) ABSTRACT

A protective helmet includes a head support fixed to a crown. The head support forms a U shape with a frontal part fixed to the frontal part of the crown. The two ends of the head support are fixed to the side walls of the crown via two attachment points. First adjustment parts adjust the length of the head support between the two attachment points and the distance separating it from the frontal part of the crown. A neckband is fixed to the occipital part of the crown and is fitted in movable manner. Second adjustment parts of the neckband adjust the distance between the neckband and the frontal part of the head support.

8 Claims, 5 Drawing Sheets

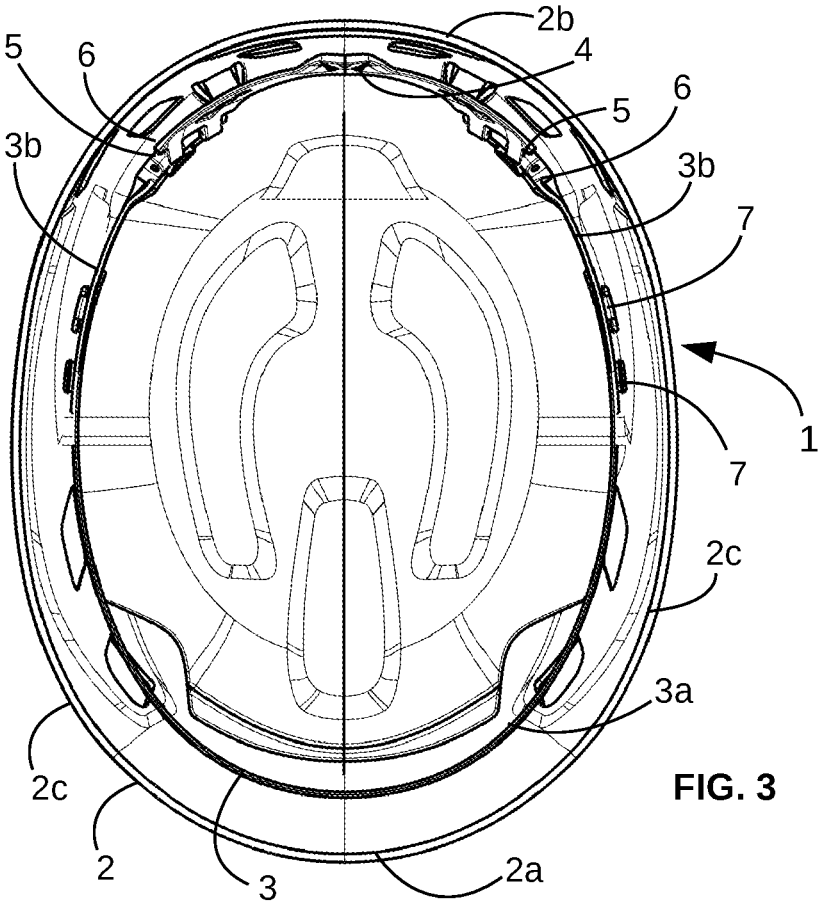
FIG. 3
FIG.4
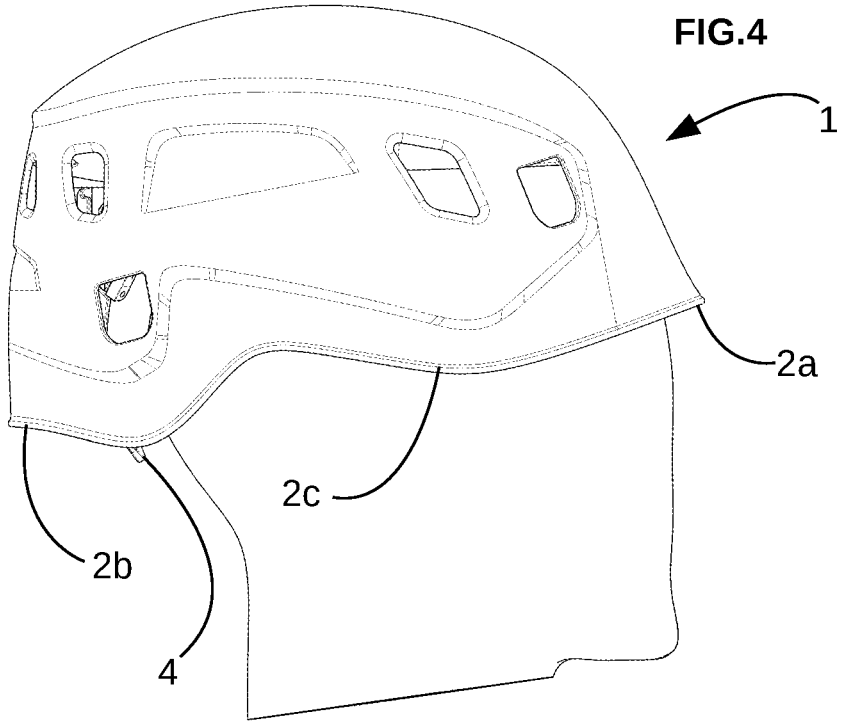

PROTECTIVE HELMET AND METHOD FOR ADJUSTING A PROTECTIVE HELMET

BACKGROUND OF THE INVENTION

The invention relates to a protective helmet comprising a system for adjusting the length of a head support that is independent from a system for adjusting the position of a neckband.

PRIOR ART

Protective helmets are for example used in mountaineering or in rock-climbing to provide protection in case of falling stones or a blow on the head. They therefore form part of the indispensable equipment for climbers and mountaineers. Document US 2015/0327617 discloses a protective helmet provided with a neckband that can deform to match the size of the user's head.

Depending on the uses, a user will have a head measurement that fluctuates according to the activities involved which generally requires him/her to have a helmet with an adjustable headband or even means that two different helmets are required. Indeed, in summer the helmet is worn directly on the head or over a thin cloth. In winter on the other hand, the user may be wearing a bonnet or a hood. If the helmet is used for canyoning, the helmet can be worn over the hood of the wetsuit. In conventional manner, depending on the size defined by the headband, the position of the helmet with respect to the median frontal plane is modified which may lead to discomfort or even to inadequacy of the helmet.

Document EP0558427 describes a helmet provided with a headband in the form of a ring with a system for adjusting the circumference of the headband by means of a rack and pinion system fixed onto the crown. The rack and pinion system enables the circumference of the headband to be adjusted and the frontal part and occipital part of the headband to be moved with respect to the crown. This solution is complicated to implement and is pricey.

The same problem arises to an even greater extent for helmets provided by collective bodies which are intended for use by the public at large and for which an even greater headband amplitude is required.

OBJECT OF THE INVENTION

One object of the invention consists in a protective helmet where the position of the median frontal plane of the helmet can be easily shifted with respect to the position of the median frontal plane of the user for several headband adjustment values.

According to one feature of the invention, a protective helmet is proposed comprising:

- a crown provided with a frontal part, an occipital part and first and second lateral parts each separating the frontal part and the occipital part,
- a head support fixed to the crown to form a U shape, the head support comprising a frontal part and first and second lateral parts separated by the frontal part,
- a first attachment point securing a first end of the head support to the first lateral part of the crown,
- a second attachment point securing a second end of the head support to the second lateral part of the crown,
- means for adjusting the head support configured to increase or reduce the length of the head support between the first and second attachment points, an increase of the length of the head support corresponding to movement of the frontal part of the head support and the frontal part of the crown towards one another and a reduction of the length of the head support corresponding to movement of the frontal part of the head support and the frontal part of the crown away from one another, the frontal part of the head support being fitted movable with respect to the first and second attachment points,
- a neckband fitted in movable manner so as to move towards or away from the frontal part of the head support, the neckband having two additional attachment points with the crown, the two additional attachment points being arranged in fixed manner on the crown independently from the length of the head support,
- means for adjusting the position of the neckband configured to define the position of the neckband with respect to the frontal part of the head support, the means for adjusting the position of the neckband being distinct from the means for adjusting the head support so as to adjust the position of the neckband and the length of the head support independently from one another, protective helmet wherein:
- the frontal part of the head support is fixed to the frontal part of the crown by at least one deformable attachment point,
- the means for adjusting the head support are located at the interface between the frontal part and each of the first and second lateral parts of the head support, the means for adjusting the head support being fixed to the crown by means of the frontal part and the first and second lateral parts of the head support, the means for adjusting the head support being arranged between the attachment point of the frontal part of the head support and each of the first and second attachment points of the first and second lateral parts of the head support.

In advantageous manner, the neckband is fitted pivotally movable on the first and second attachment points respectively around two swivel pins that are not colinear and not orthogonal, the positions of the two swivel pins being unchanged with respect to the crown when the length of the head support is modified.

In a particular configuration, the frontal part and first and second lateral parts of the head support define a plurality of predefined positions corresponding to a plurality of length values of the head support.

Preferentially, the first attachment point and second attachment point are rigid, removable connection points.

According to one embodiment, the mechanical connection between the frontal part of the head support and the crown defines at least two axes of rotation arranged in such a way that when the frontal part of the head support moves away from the frontal part of the crown, the frontal part of the head support moves towards the apex of the crown.

According to another embodiment, the means for adjusting the position of the neckband are formed by a flexible element connecting the neckband with the frontal part of the crown or of the head support and a block fastener having a first state allowing sliding along the flexible element and configured to define multiple blocking positions of the block fastener on the flexible element and a second state in which the block fastener is fixed on the flexible element.

One object of the invention is to provide a method for adjusting a protective helmet that achieves a better centring of the helmet on the head.

The method for adjusting a protective helmet successively comprises:

increasing or reducing the length of the head support to move the frontal part of the head support and the frontal part of the crown towards or away from one another and to define a length of the head support, and adjusting the distance separating the neckband from the frontal part of the head support.

Preferentially, the method comprises removal of the first and second attachment points with respect to the crown before adjusting the length of the head support and refitting of the first and second attachment points before adjusting the distance separating the neckband from the frontal part of the head support.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which:

FIG. 3 schematically illustrates a bottom view of the protective helmet with a head support presenting a maximum length and a neckband in the rest position;

FIG. 4 schematically illustrates a side view of a helmet on a head, the helmet being offset to the rear;

DESCRIPTION OF THE EMBODIMENTS

Figure 1:
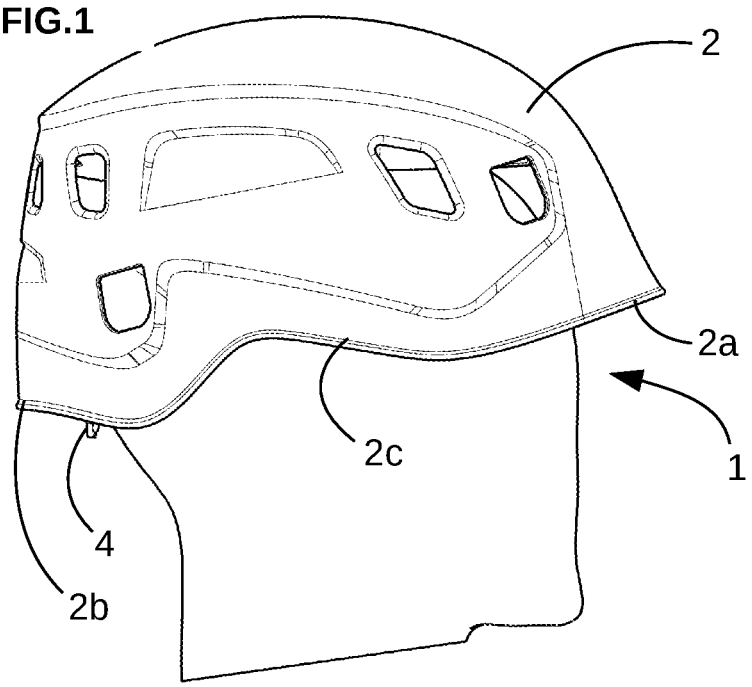
FIG. 1 schematically illustrates a side view of a helmet on a head.
Figure 2:
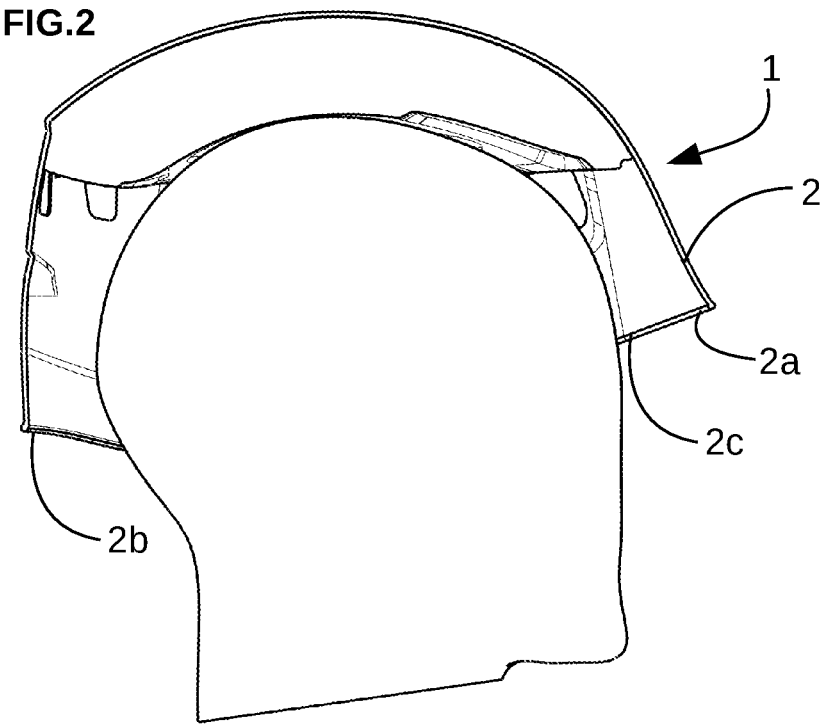
FIG. 2 schematically illustrates a cross-sectional view in the median sagittal plane of the crown centred on the head.

FIGS. 1, 2 and 3 represent a protective helmet 1 comprising a crown 2 made from a material preventing it from folding onto itself. Crown 2 can preferentially be made from plastic, for example from polycarbonate or injected ABS or from polystyrene or from expanded polypropylene, or from any other plastic material, in particular injected, thermoformed or foam plastic material.

Crown 2 comprises a frontal part 2*a* located at the front, i.e. near the user's forehead, and an occipital part 2*b* located at the rear. Frontal part 2*a* is separated from occipital part 2*b* by two lateral parts 2*c*, respectively right and left. Protective helmet 1 is provided with a head support 3 and a neckband 4. Head support 3 is fixed to crown 2 so as to form a U shape. U-shaped head support 3 is closed by neckband 4 to pass right round the user's head.

Figure 10:
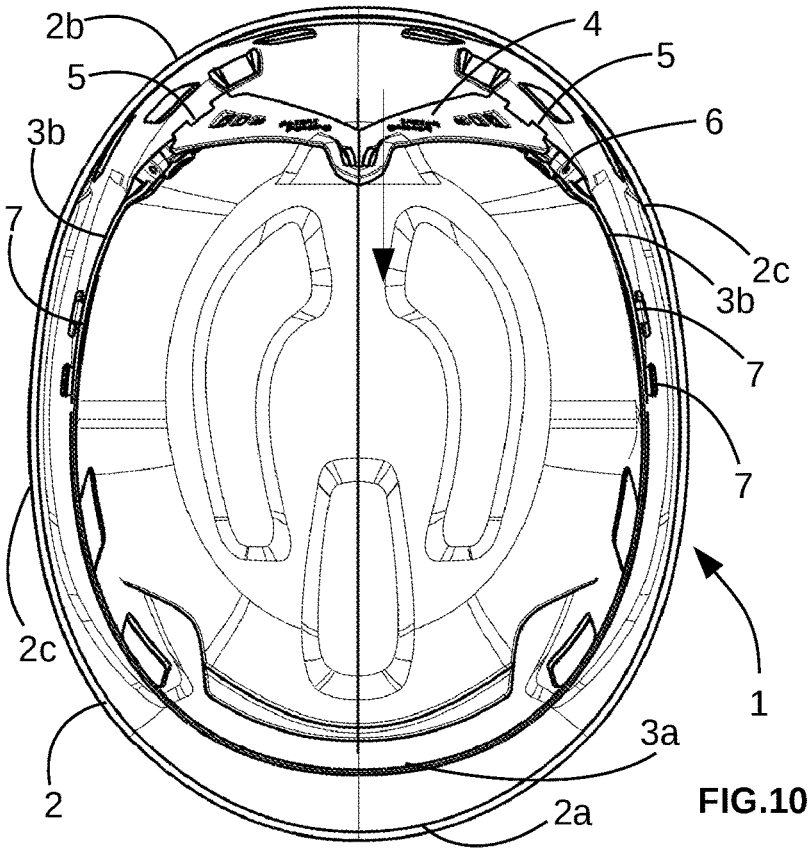
FIG. 10 schematically illustrates a bottom view of the protective helmet with a head support presenting a maximum length and a neckband folded towards the frontal part of the head support.
Figure 11:
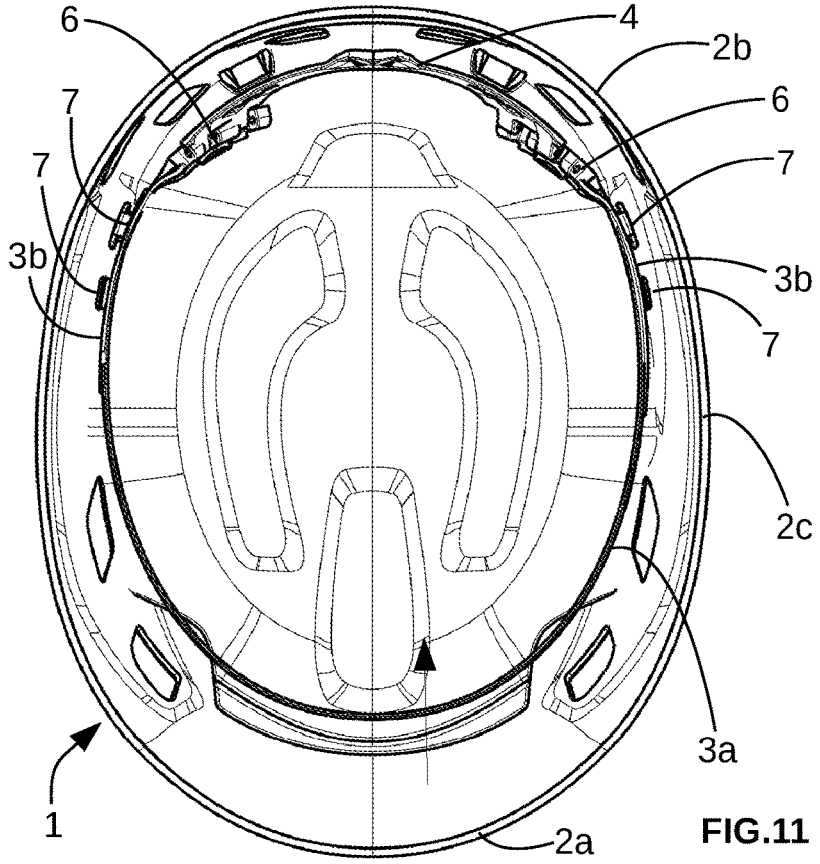
FIG. 11 schematically illustrates a bottom view of the protective helmet with a head support presenting a reduced length and a neckband in the rest position.

Head support 3 comprises a frontal part 3*a* and two lateral parts, respectively right and left, 3*b* as illustrated in FIGS. 3, 10 and 11. The two lateral parts 3*b* are separated by frontal part 3*a*. Head support 3 is designed to come into contact with the user's head. Frontal part 1*a* is designed to come into contact with the user's forehead whereas each of the lateral parts 3*b* is designed to come into contact with the lateral parts of the user's head. Head support 3 is designed to separate the head and crown 2.

Head support 3 is fixed to crown 2. More precisely, frontal part 3*a* of head support 3 is fixed to frontal part 2*a* of crown 2 via one or more frontal attachment points 11. The two ends of head support 3 are fixed to lateral parts 2*c* of crown 2 via first and second attachment points 6. First and second attachment points 6 are advantageously located in the rear part of crown 2, i.e. in the rear half of crown 2 with respect to the median frontal plane of crown 2.

Helmet 1 comprises means for adjusting head support 3 that are configured to adjust the length of head support 3. Head support 3 is adjustable so as to define several different length values of head support 3. The length of head support 3 is modified between first and second attachment points 6. First and second attachment points 6 are fixed on crown 2 regardless of the length of head support 3.

By adjusting the length of head support 3, the means for adjusting head support 3 are able to adjust the distance separating frontal part 3*a* of head support 3 and frontal part 2*a* of crown 2. Increasing the effective length of head support 3 corresponds to moving frontal part 3*a* of head support 3 and frontal part 2*a* of crown 2 towards one another. Reducing the effective length of head support 3 corresponds to increasing the distance separating frontal part 3*a* of head support 3 and frontal part 2*a* of crown 2. The adjustment means adjust the length of head support 3 so as to adjust the distance between frontal part 3*a* of head support 3 and frontal part 2*a* of crown 2. Adjustment of the length of head support 3 enables the position of the user's forehead to be defined with respect to frontal part 2*a* of crown 2 and therefore performs centring of the head inside the helmet. By using a U-shaped head support 3 associated with ends mounted fixed on crown 2, adjustment of the length of head support 3 enables the position of frontal part 3*a* to be adjusted simply and precisely.

Neckband 4 is fitted movable with respect to frontal part 3*a* of head support 3 and to frontal part 2*a* of crown 2. Neckband 4 is fitted movable with respect to frontal part 3*a* of head support 3 so as to adjust the available space between neckband 4 and the front part of crown 2 and to press the user's forehead against frontal part 3*a*. Movement of neckband 4 enables the distance between occipital part 2*b* of crown 2 and the occipital bone to be defined.

Neckband 4 presses on the occipital part of the head to press the forehead against frontal part 3*a* of head support 3 thereby defining the position of the head with respect to crown 2.

Helmet 1 comprises means for adjusting the position of neckband 4 that are configured to define the position of neckband 4 with respect to frontal part 3*a* of head support 3. The means for adjusting neckband 4 are distinct from the means for adjusting the length of head support 3 so as to adjust neckband 4 and head support 3 independently from one another.

Movement of neckband 4 and adjustment of head support 3 enable the head to be centred in crown 2 by defining the distance between the occipital part of crown 2 and neckband 4 and the distance between frontal part of head support 3 and the frontal part of crown 2 independently from one another. Once the length of the head support has been defined, the means for adjusting neckband 4 enable the distance separating neckband 4 from frontal part 3*a* of head support 3 to be defined.

In this way, helmet 1 can be better centred on the user's head using independent means for adjusting the position of the forehead with respect to the frontal part of crown 2 and the position of the occipital bone with respect to the occipital part of crown 2.

In a particular embodiment, the means for adjusting neckband 4 are fixed on the one hand to neckband 4 and on the other hand to frontal part 2*a* of crown 2 and/or to frontal part 3*a* of head support 3 so as to define the distance between neckband 4 and frontal part 3*a* of head support 3. Preferably, the means for adjusting neckband 4 are fixed to frontal part 2*a* of crown 2.

The means for adjusting head support 3 are configured so that frontal part 3*a* of head support 3 is fitted movable with respect to each of lateral parts 3*b* in a longitudinal direction of head support 3. The longitudinal direction is substantially included in a transverse plane of the user. In the illustrated configuration, head support 3 does not define a ring. The longitudinal direction extends from one end of head support 3 to the opposite end in the direction of the larger dimension. The longitudinal direction connects the two attachment points 6 with crown 2.

Neckband 4 is provided with two additional attachment points with crown 2. The two additional attachment points are fixed on crown 2 independently from the length of head support 3. Neckband 4 can have any configuration provided that the position of neckband 4 is able to be adjusted independently from the length of head support 3.

In a particularly advantageous embodiment, the two additional attachment points of neckband 4 correspond to first and second attachment points 6 between head support 3 and crown 2. The same attachment point 6 is used to secure neckband 4 and head support 3 with crown 2. In advantageous manner, neckband 4 is fitted pivoting around at least one swivel pin 5 with respect to occipital part 2*b* of crown 2. In the illustrated embodiment, neckband 4 is fitted pivoting with respect to two swivel pins 5 that are not colinear and advantageously not orthogonal. Movement of neckband 4 with respect to frontal part 3*a* of head support 3 results in deformation of neckband 4 so that, if no force is applied by the means for adjusting neckband 4, neckband 4 is in a rest position. The rest position is independent from the length of head support 3.

In configurations of the prior art, when the dimensions of the head correspond to the smallest dimensions accepted by helmet 1, neckband 4 presses the user's forehead against frontal part 3*a* of head support 3 resulting in the user's head being offset towards frontal part 2*a* of crown 2. Such a configuration is illustrated in FIG. 4. This configuration may be a source of discomfort. It is therefore particularly advantageous to move the occipital part of head towards the occipital part of crown 2. The helmet according to the invention enables the helmet to be recentred by increasing the distance between frontal part 2*a* of crown 2 and frontal part 3*a* of head support 3 by reducing the length of head support 3.

It is advantageous for neckband 4 to be fitted pivotally and preferentially by means of the two swivel pins 5 which are fitted fixed with respect to crown 2 independently from the length of head support 3. In advantageous manner, the two lateral parts 3*b* of head support 3 are fixed to the two lateral parts 2*b* of crown 2 so that the at least one swivel pin 5 is immovable with respect to crown 2. In this configuration, the pivoting connection between head support 3 and neckband 4 does not move in spite of the adjustment of the length of head support 3. By defining the length of head support 3, the user defines the distance between frontal part 3*a* and frontal part 2*a*. He/she can then secure helmet 1 on his/her head using neckband 4 which deforms. Deformation of neckband 4 is designed to push the forehead against frontal part 3*a*.

In a particular embodiment, the means for adjusting head support 3 are configured to allow an infinity of different values of the length of head support 3 to be defined, for example by using a strap operating in conjunction with a strap fastener. However it becomes apparent from use that it is preferable to provide adjustment means that are configured so that frontal part 3*a* and occipital part 3*b* of head support 3 define a plurality of predefined positions corresponding to a plurality of length values of head support 3, with a finite number of possibilities, for example less than 5 different adjustment possibilities. In an advantageous embodiment, the adjustment means are configured so as to define 2 or 3 different lengths of head support 3. This adjustment of the length of head support 3 makes it possible to adapt a single dimension of crown 2 to match a larger variety of user head sizes. The use of a predefined number of length values of head support 3 less than 5 seems sufficient to ensure good user comfort for different head sizes.

To facilitate centring of helmet 1 on the user's head, it is advantageous for each lateral part 3*b* of head support 3 to be fixed to lateral part 2*c* of crown 2 by means of a rigid connection 6. It is particularly advantageous for each lateral part 3*b* of head support 3 to be fitted removably with respect to lateral part 2*c* of crown 2. This makes it possible to remove at least a part of head support 3 to facilitate its adjustment. It is also advantageous for frontal part 3*a* of head support 3 to be fitted irremovable with respect to crown 2.

In a particularly advantageous configuration illustrated in FIG. 3, the two lateral parts 3*b* of head support 3 are formed by two parts fitted movable with respect to frontal part 3*a*. The two lateral parts 3*b* are fitted movable independently from one another with respect to frontal part 3*a*. The two lateral parts 3*b* are connected to one another on the one hand by frontal part 3*a* and connected to one another by neckband 4. Each of the two lateral parts 3*b* is fixed to neckband 4 by means of a pivot shaft defining axis 5.

In the illustrated configuration, the two pivot shafts 5 perform connection between one connecting end of neckband 4 and one of the two lateral parts 3*b* of head support 3. Each lateral part 3*b* is fixed to crown 2 so that the two connecting ends of neckband 4 are fixed or substantially fixed with respect to crown 2.

Figure 5:
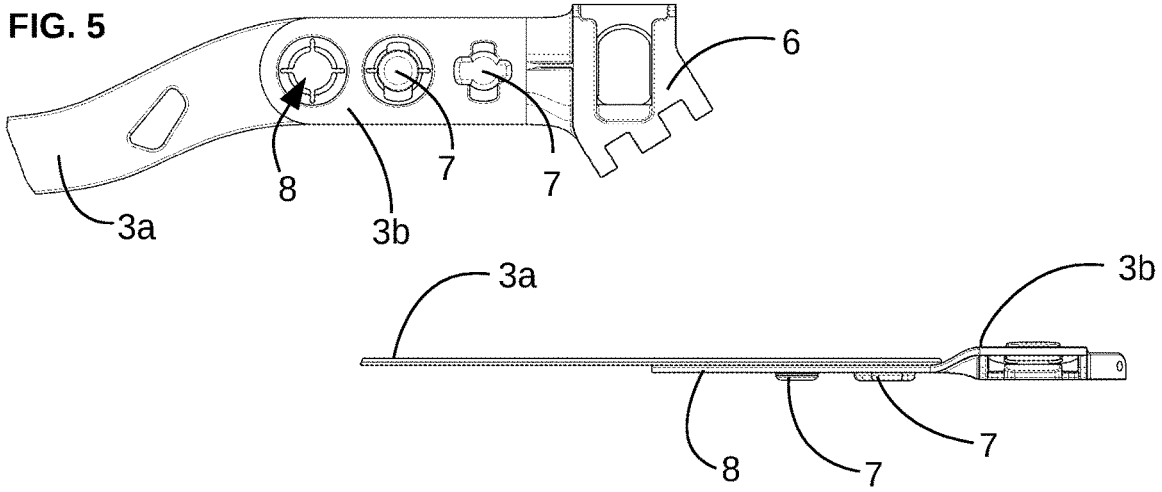
FIG. 5 schematically illustrates a side view and a top view of a portion of the head support with the connection between the frontal part and a right-hand lateral part.

Preferentially, each lateral part 3*b* of head support 3 is fitted removably with respect to frontal part 3*a* of head support 3 to facilitate adjustment of the length of head support 3 and the overlap distance between frontal part 3*a* and lateral part 3*b*. The means for adjusting head support 3 are configured to define a plurality of distinct adjustment positions defining several different values of the length of head support 3. In a particular configuration illustrated in FIGS. 5 to 9, frontal part 3*a* defines a plurality of salient areas 7 and lateral part 3*b* defines holes 8 which insert into salient areas 7. Cooperation between salient areas 7 and holes 8 defines at least two different lengths of head support 3. The use of a system with holes 8 and salient areas 7 enables an efficient adjustment to be performed by proposing several predefined values of the length of head support 3. This also enables an adjustment means to be formed presenting a small volume limiting the risks of injury in case of impacts on helmet 1. FIG. 5 illustrates a connection configuration between one end of frontal part 3*a* and a lateral part 3*b* of head support 3. The salient areas and holes can be inverted between the frontal part and the lateral part.

Figure 6A:
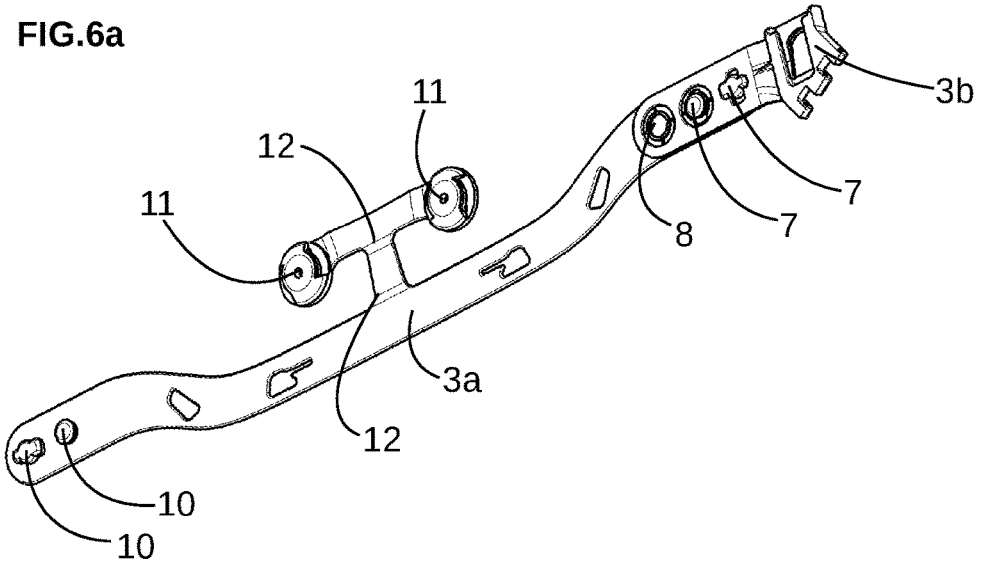
FIGS. 6*a* and 6*b* schematically illustrate a perspective view and a bottom view of a portion of the head support with the connection between the frontal part and a right-hand, respectively left-hand, lateral part.
Figure 6B:
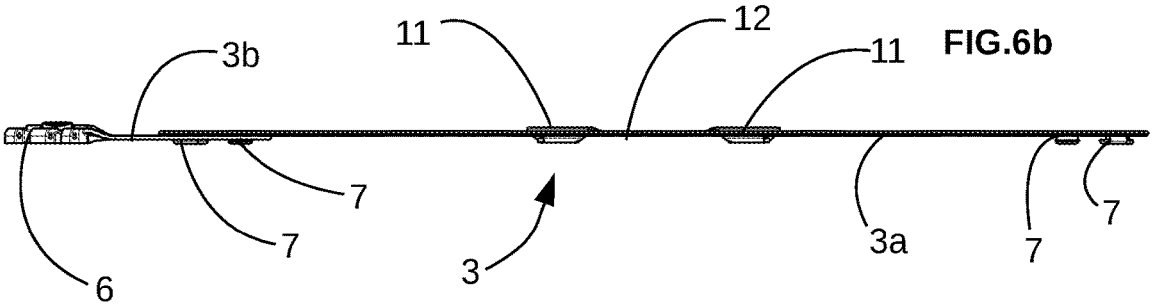

FIG. 6*a* illustrates a head support 3 with frontal part 3 connected to right-hand lateral part 3*b*. Left-hand end of head support 3 is not connected to left-hand lateral part 3*b*. Frontal part 3*a* has two frontal attachment points 11 joined by a connector defining two axes of rotation 12 enabling head support 3 to move with respect to crown 2. FIG. 6*b* illustrates a head support 3 with frontal part 3 connected to left-hand lateral part 3*b*.

In advantageous manner, one of salient areas 7 is configured to enable frontal part 3*a* and lateral part 3*b* to be secured to or separated from one another when lateral part 3*b* and frontal part 3*a* define a first orientation or configuration and to prevent separation between frontal part 3*a* and lateral part 3*b* when lateral part 3*b* and frontal part 3*a* are in a second orientation/configuration different from the first orientation/configuration.

Frontal part 3*a* can define a salient area 7 which operates in conjunction with another hole 8 so as to define a second connection point which blocks the position of frontal part 3*a* with respect to lateral part 3*b* and prevents rotation of lateral part 3*b* with respect to frontal part 3*a* and secures frontal part 3*a* and occipital part 3*b* preventing them from becoming separated.

Figure 7:
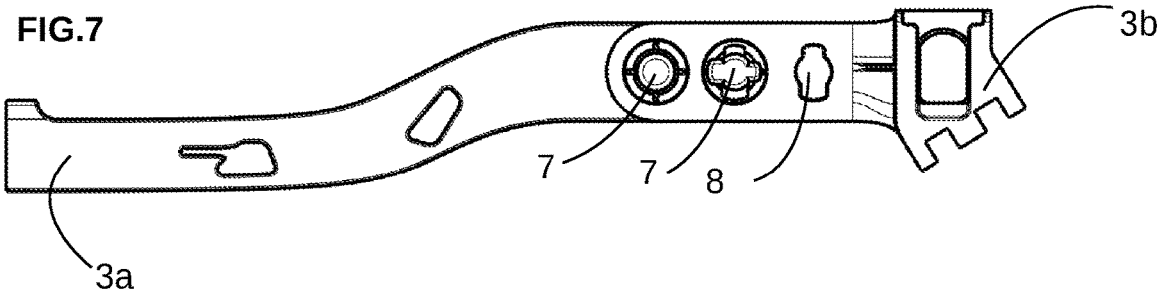
FIG. 7 schematically illustrates a side view of a portion of the head support with the connection between the frontal part and a lateral part, FIG. 7 defining a longer head support than that of the configuration of FIG. 5.

In the embodiment illustrated in FIGS. 6*a* and 6*b*, frontal part 3*a* of head support 3 is provided with two connection parts configured to cooperate with two complementary connection parts arranged on occipital part 3*b*. FIG. 5 illustrates a configuration where frontal part 3*a* and lateral part 3*b* define a head support 3 of reduced length whereas FIG. 7 illustrates a configuration where frontal part 3*a* and occipital part 3*b* define a head support of larger length.

In advantageous manner, the mechanical connection between frontal part 3*a* of head support 3 and frontal part 2*a* of crown 2 defines at least two axes of rotation arranged so that when frontal part 3*a* of head support 3 moves away from frontal part 2*a* of crown 2, frontal part 3*a* of head support 3 moves towards the apex of crown 2. This configuration enables the mechanical connection to be kept between frontal part 2*a* and frontal part 3*a* regardless of the value defined by head support 3 and provides good user comfort.

In the embodiment illustrated in FIGS. 6*a* and 6*b*, frontal part 3*a* has one or more connectors 11 that fix frontal part 3*a* of head support 3 on frontal part 2*a* of crown 2. Connectors 11 are offset with respect to an axis connecting the two connection parts with occipital part 3*b*. Connectors 11 are separated from the axis which connects the two connection parts by two axes of rotation 12. The two axes of rotation 12 allow an offset between the frontal part of crown 2*a* and the frontal part of head support 3*a* while enabling the frontal part of head support 3 to fit the shape of the forehead. Frontal part 3*a* of head support 3 remains fixed to frontal part 2*a* of crown 2 to provide a sufficient strength in use and to prevent crown 2 from rocking with respect to head support 3. The two axes of rotation 12 are advantageously parallel to one another and parallel to the longitudinal axis of head support 3.

In advantageous manner, connectors 11 of frontal part 3*a* and attachment points 6 of occipital part 3*b* are separated by the adjustment needs and preferentially by the fixing parts so that head support 3 is kept tight between attachment points 6 and frontal part 3*a* when helmet 1 is clamped tight on the user's head.

Preferentially, frontal part 3*a* has two connectors 11 located on each side of the median sagittal plane of helmet 1.

The means for adjusting neckband 4 can be formed by a rope or strap fixed on the one hand to neckband 4 and on the other hand to crown 2 or to head support 3. The rope or strap is preferentially associated with a fastening means, for example a buckle, a hook or a tanka fastener. It is also possible to use an adjustment system with an adjustment wheel or a rack.

In a particular embodiment, the inner part of the apex of crown 2 is lined with foam to prevent direct contact between the head and the crown and to absorb shocks.

Such a configuration provides a particular advantage for protective helmets intended for collective bodies which have to be adjusted to fit a large number of different users while remaining comfortable and simple to adjust.

As indicated in the foregoing, the system for adjusting the length of head support 3 is dissociated from the system for adjusting neckband 4. A novice user will only have to deal with adjusting neckband 4 by means of a conventional adjustment system. Head support 3 is adjusted beforehand to define its effective length and therefore an accessible headband range.

Figure 8:
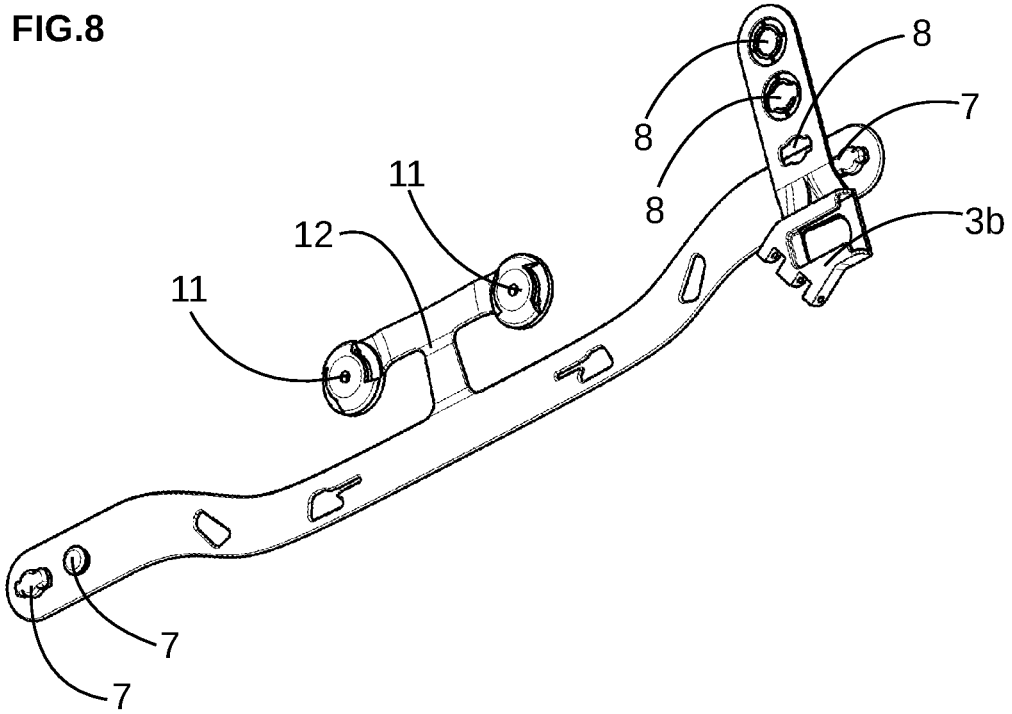
FIG. 8 schematically illustrates a perspective view of a first step of fitting of a lateral part on the frontal part of the head support.
Figure 9:
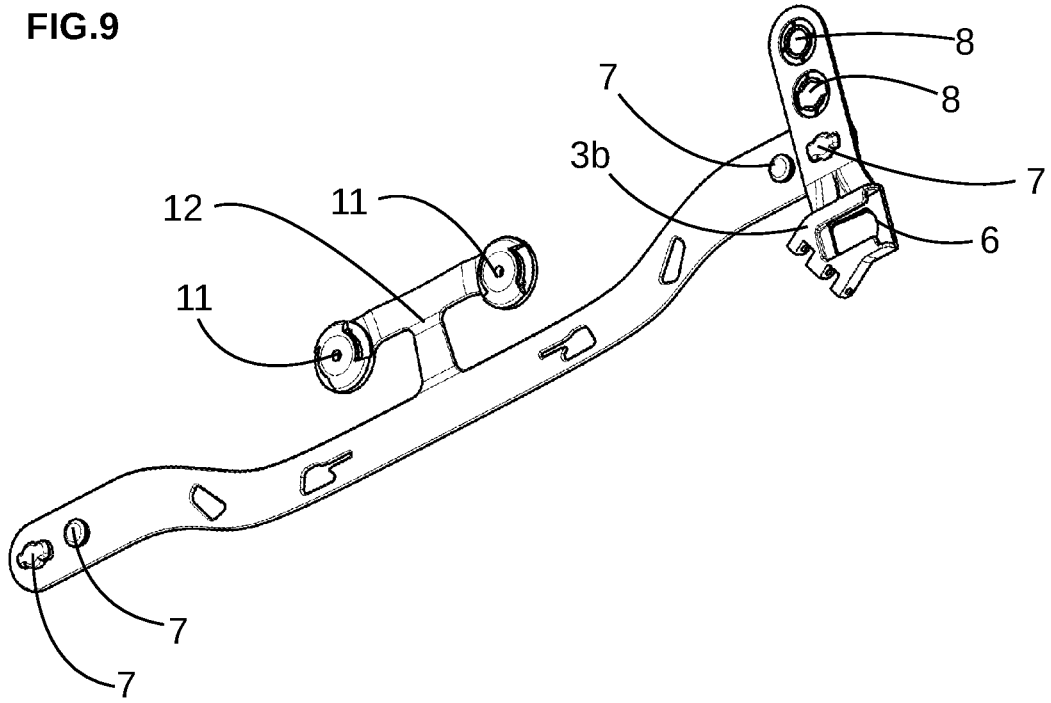
FIG. 9 schematically illustrates a perspective view of a second step of fitting of a lateral part on the frontal part of the head support to form an assembly as illustrated in FIGS. 6*a* and 6*b;*

FIGS. 8 and 9 illustrate installation of a lateral part 3*b* on frontal part 3*a*. Lateral part 3*b* is presented facing frontal part 3*a* with a first orientation to allow insertion of a salient area 7 in one of the holes as illustrated in FIG. 8. Lateral part 3*b* is fixed to frontal part 3*a* as illustrated in FIG. 9 and lateral part 3*b* then rotates with respect to frontal part 3*a* so as to prevent the two from becoming separated. A second salient part 7 is then inserted in a second hole 8 to prevent rotation between lateral part 3*b* and frontal part 3*a*.

FIG. 10 illustrates the movement of neckband 4 towards frontal part 3*a* of head support 3 as neckband 4 is progressively tightened in comparison with FIG. 3. FIG. 11 illustrates the modification of the position of frontal part 3*a* in comparison with FIG. 3.

The invention claimed is:

1. A protective helmet comprising:

a crown provided with a frontal part, an occipital part and first and second lateral parts each separating the frontal part and the occipital part, a head support fixed to the crown to form a U shape, the head support comprising a frontal part and first and second lateral parts separated by the frontal part, a first attachment point fixing a first end of the head support to the first lateral part of the crown, a second attachment point fixing a second end of the head support to the second lateral part of the crown, at least one frontal attachment point connecting the frontal part of the head support and the frontal part of the crown, the at least one attachment point forming a deformable connection between the crown and the head support authorizing a movement between the frontal part of the head support and the frontal part of the crown, an adjuster configured to adjust a length of the head support between the first attachment point and the second attachment point, the frontal part of the head support being mounted movable with respect to the first lateral part and with respect to the second lateral part to increase or reduce the length of the head support between the first attachment point and the second attachment point, the adjuster being disposed between the first attachment point and the at least one frontal attachment point and between the second attachment point and the at least one frontal attachment point, wherein an increase of the length of the head support corresponding to a movement of the frontal part of the head support toward the frontal part of the crown and a reduction of the length of the head support corresponding to a movement of the frontal part of the head support away from the frontal part of the crown, wherein the frontal part of the head support is mounted movable with respect to the first lateral part to increase or reduce a length of the head support between the first attachment point and the at least one frontal attachment point, wherein the frontal part of the head support is mounted movable with respect to the second lateral part to increase or reduce a length of the head support between the second attachment point and the at least one frontal attachment point, and a neckband fitted in movable manner so as to move towards or away from the frontal part of the head support, the neckband having two additional attachment points with the crown, the two additional attachment points being arranged in fixed manner on the crown independently from the length of the head support.

2. The protective helmet according to claim 1, wherein the neckband is fitted pivotally movable on the first attachment point and second attachment point respectively around two swivel pins that are not colinear and not orthogonal, the positions of the two swivel pins being unchanged with respect to the crown when the length of the head support is modified.

3. The protective helmet according to claim 1, wherein the frontal part and first and second lateral parts of the head support define a plurality of predefined positions corresponding to a plurality of length values of the head support.

4. The protective helmet according to claim 1, wherein the first attachment point and second attachment point are rigid, removable connection points between the head support and the crown.

5. The protective helmet according to claim 1, wherein a mechanical connection between the frontal part of the head support and the crown defines at least two axes of rotation arranged in such a way that when the frontal part of the head support moves away from the frontal part of the crown, the frontal part of the head support moves towards an apex of the crown.

6. A method for adjusting the protective helmet according to claim 1 successively comprising:

increasing or reducing the length of the head support to move the frontal part of the head support and the frontal part of the crown towards or away from one another and to define a length of the head support, and adjusting the distance separating the neckband from the frontal part of the head support.

7. A method for adjusting a protective helmet comprising:

a crown provided with a frontal part, an occipital part and first and second lateral parts each separating the frontal part and the occipital part, a head support fixed to the crown to form a U shape, the head support comprising a frontal part and first and second lateral parts separated by the frontal part, a first attachment point fixing a first end of the head support to the first lateral part of the crown, a second attachment point fixing a second end of the head support to the second lateral part of the crown, at least one frontal attachment point connecting the frontal part of the head support and the frontal part of the crown, the at least one attachment point forming a deformable connection between the crown and the head support authorizing a movement between the frontal part of the head support and the frontal part of the crown, wherein the frontal part of the head support is mounted movable with respect to the first lateral part and with respect to the second lateral part to increase or reduce a length of the head support between the first attachment point and the second attachment point and to move the frontal part with respect to the crown, an increase of the length of the head support corresponding to a movement of the frontal part of the head support toward the frontal part of the crown and a reduction of the length of the head support corresponding to a movement of the frontal part of the head support away from the frontal part of the crown, wherein the frontal part of the head support is mounted movable with respect to the first lateral part to increase or reduce a length of the head support between the first attachment point and the at least one frontal attachment point, wherein the frontal part of the head support is mounted movable with respect to the second lateral part to increase or reduce a length of the head support between the second attachment point and the at least one frontal attachment point, and a neckband fitted in movable manner so as to move towards or away from the frontal part of the head support, the neckband having two additional attachment points with the crown, the two additional attachment points being arranged in fixed manner on the crown independently from the length of the head support, the method comprising:

increasing or reducing the length of the head support to move the frontal part of the head support and the frontal part of the crown towards or away from one another and to define a length of the head support, adjusting the distance separating the neckband from the frontal part of the head support, and removing the first and second attachment points with respect to the crown before adjusting the length of the head support and refitting of the first and second attachment points before adjusting the distance separating the neckband from the frontal part of the head support.

8. The method for adjusting according to claim 6, further comprising removing the first and second attachment points with respect to the crown before adjusting the length of the head support and refitting the first and second attachment points before adjusting the distance separating the neckband from the frontal part of the head support.

* * * * *